US007989688B2

(12) United States Patent
Luo

(10) Patent No.: US 7,989,688 B2
(45) Date of Patent: Aug. 2, 2011

(54) PEDAL FOR MUSICAL INSTRUMENTS

(75) Inventor: Ying-Chin Luo, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 0 days.

(21) Appl. No.: 12/655,127

(22) Filed: Dec. 23, 2009

(65) Prior Publication Data

US 2011/0146474 A1 Jun. 23, 2011

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 2,845,830 A * 8/1958 Haviland ..... 84/422.1
3,988,957 A * 11/1976 Escamilla ..... 84/422.1
4,945,803 A * 8/1990 Norwood ..... 84/422.1
5,361,670 A * 11/1994 Lombardi ..... 84/422.1
5,396,826 A * 3/1995 Lombardi ..... 84/422.1
5,421,234 A * 6/1995 Liao ..... 84/422.1
5,421,235 A * 6/1995 Lombardi ..... 84/422.1
5,431,081 A * 7/1995 Lombardi et al. ..... 84/422.1
5,567,899 A * 10/1996 Hoshino ..... 84/422.1
5,578,777 A * 11/1996 Lombardi ..... 84/422.1
6,002,076 A * 12/1999 Karn ..... 84/422.1
6,271,450 B1 * 8/2001 Mackie ..... 84/422.1
6,541,686 B2 * 4/2003 O'Donnell ..... 84/422.1
6,649,820 B2 * 11/2003 Sassmannshausen ..... 84/422.1

* cited by examiner

*Primary Examiner* — Lincoln Donovan
*Assistant Examiner* — Robert W Horn
(74) *Attorney, Agent, or Firm* — Charles E. Baxley

(57) ABSTRACT

A pedal has a base, two supporting posts, a pedal plate, a first shaft, a second shaft, a chain assembly and two beaters. The pedal plate is mounted pivotally on the base. The first and second shafts are rotatably mounted respectively on the supporting posts, are connected concentrically together and are capable of rotating independently. The chain assembly connects the pedal plate to the first shaft. The beaters are mounted respectively on the first and second shafts. The concentrically connected first and second shafts serve as a crossbeam between the supporting posts to reinforce the structurally strength of the pedal and obviate additional crossbeams that limit the pivoting range of the pedal.

11 Claims, 9 Drawing Sheets

PEDAL FOR MUSICAL INSTRUMENTS

BACKGROUND OF THE INVENTION

1. Field of the Invention

The present invention relates to a pedal, and more particularly to a pedal that is used for drum-like musical instruments and has two posts and two shafts connected concentrically together and serving as a crossbeam between the posts for structurally reinforcing and simplifying purposes.

2. Description of Related Art

Percussion instruments such as crash cymbals, tom-toms, snare drums and bass drums are commonly used in performances. For example, a bass drum is set under the ground near a player's feet and a drum pedal is connected to the bass drum and has a beater selectively driven by the player to strike the bass drum to play music.

A conventional drum pedal comprises a base, two posts, a pedal plate, two shafts, a crossbeam, two beaters, a chain and two positioning devices. The posts are mounted uprightly on the base. The pedal plate is mounted on the base between the posts and has a rear end mounted pivotally on the base and a fore end lifted up. The shafts are transversely and rotatably mounted respectively on the posts. The crossbeam is mounted securely between and reinforces the posts. The beaters are pivotally mounted respectively on the shafts and each beater has a striking head capable of striking a bass drum. The chain has two ends, one end is mounted securely on one shaft and the other end is mounted on the fore end of the pedal plate so that pivoting the pedal plate drives one beater to strike. The positioning devices are mounted respectively on the posts and are connected respectively to the shafts and provide resilient forces to recover the shafts to a specific angle relative to the base when no external forces are applied to the shafts. Furthermore, a secondary pedal is connected to the other shaft that is separated from the aforementioned pedal plate so that a player is capable of stepping on both the drum pedal and secondary pedal to simultaneously control the beaters.

To drive the beaters independently without interference therebetween, the shafts are separated from each other. Thus, the crossbeam is necessarily mounted between the posts to ensure that the posts, pedal plates, shafts, beaters are precisely and firmly assembled without accidentally twisting.

However, the crossbeam mounted between the posts limits an angle of elevation of the pedal plate and the pivoting angular range of the beaters, which disadvantages adjustment of the drum pedal for different users or applications.

To overcome the shortcomings, the present invention provides a pedal for musical instruments to mitigate or obviate the aforementioned problems.

SUMMARY OF THE INVENTION

The main objective of the invention is to provide a pedal that is used for drum-like musical instruments and has two posts and two shafts connected concentrically together and serving as a crossbeam between the posts for structurally reinforcing and simplifying purposes.

A pedal in accordance with the present invention has a base, two supporting posts, a pedal plate, a first shaft, a second shaft, a chain assembly and two beaters. The pedal plate is mounted pivotally on the base. The first and second shafts are rotatably mounted respectively on the supporting posts, are connected concentrically together and are capable of rotating independently. The chain assembly connects the pedal plate to the first shaft. The beaters are mounted respectively on the first and second shafts.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
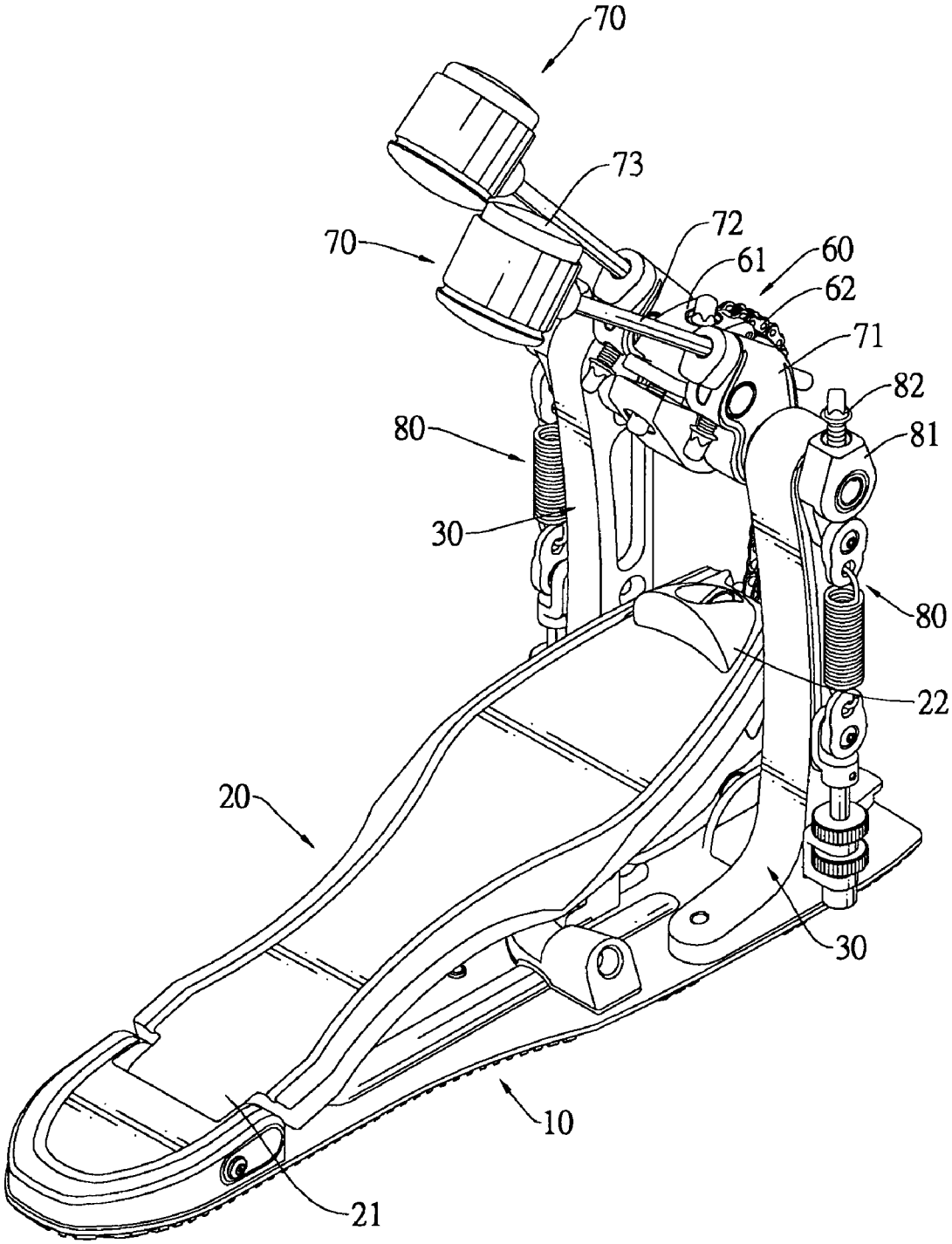
FIG. 1 is a perspective view of a pedal for musical instruments in accordance with the present invention.
Figure 2:
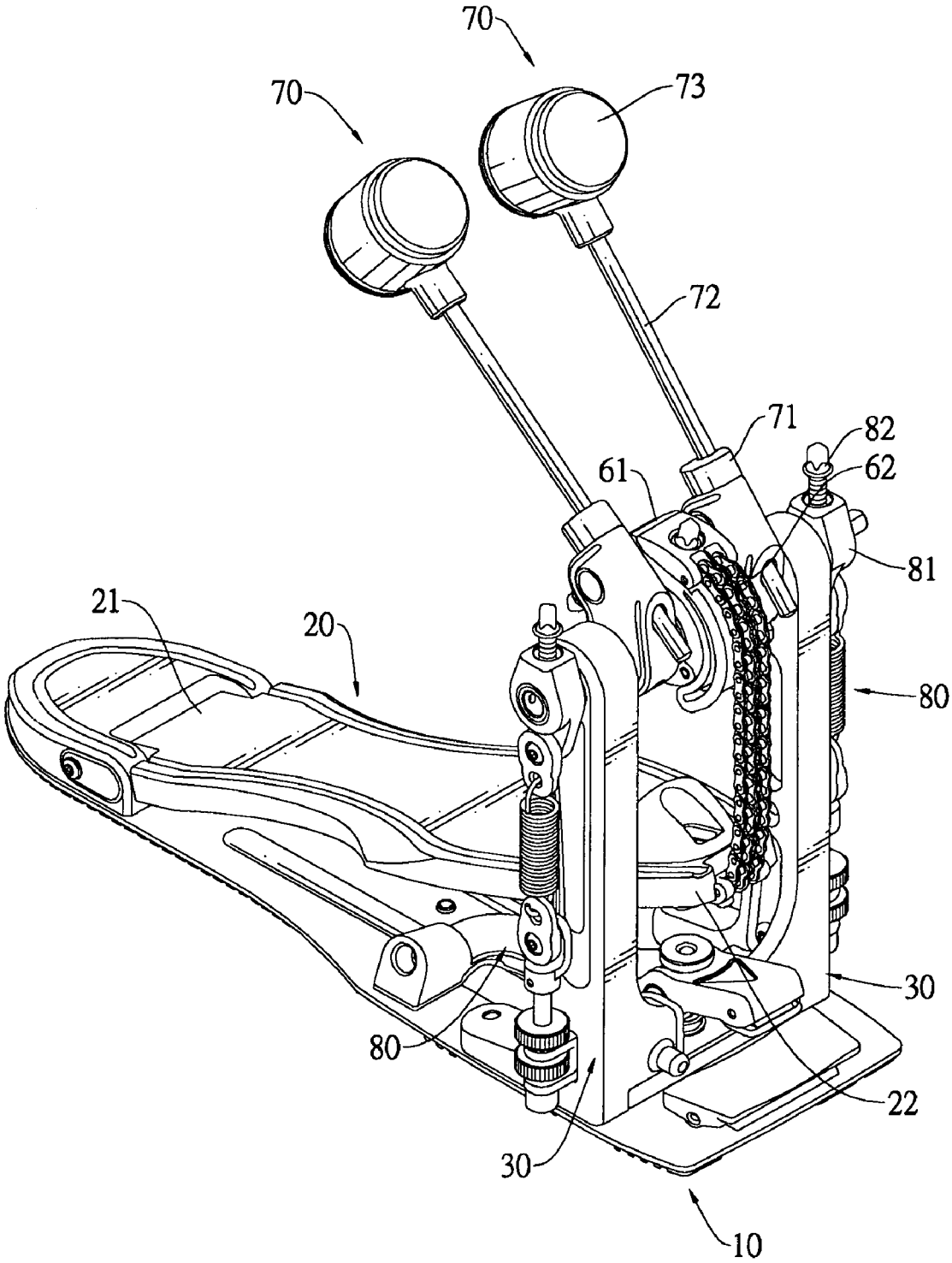
FIG. 2 is another perspective view of the pedal in FIG. 1.
Figure 3:
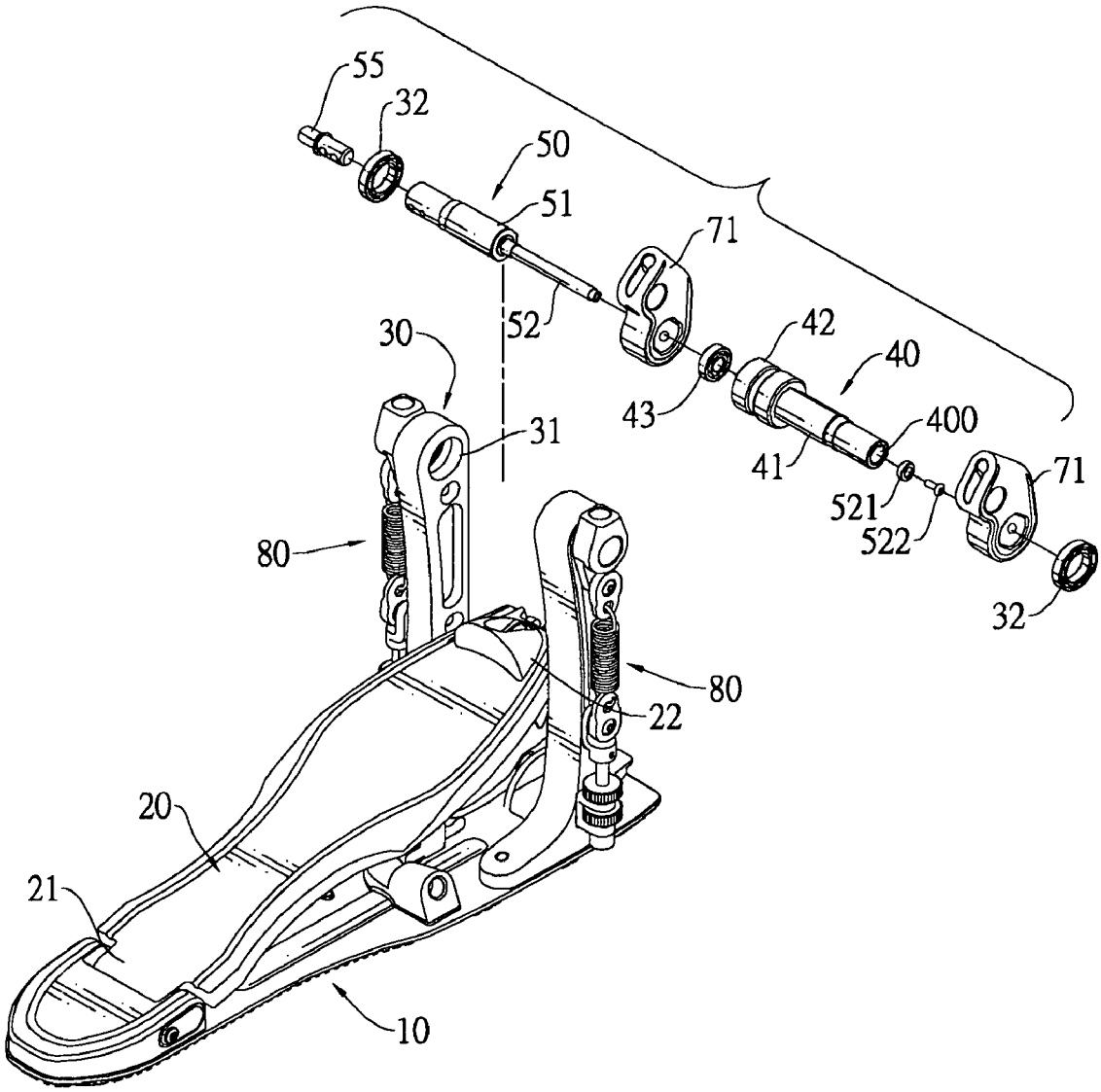
FIG. 3 is a partially exploded perspective view of the pedal in FIG. 1.
Figure 4:
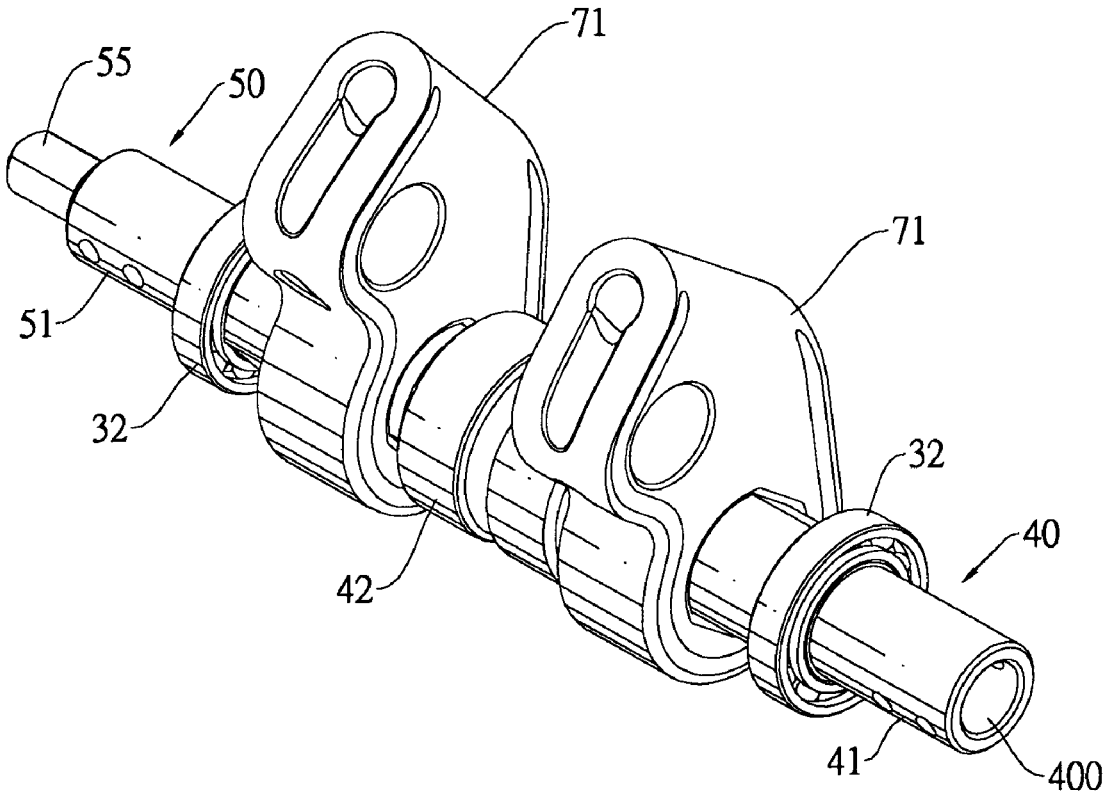
FIG. 4 is an enlarged perspective view of first and second shafts of the pedal in FIG. 1.
Figure 5:
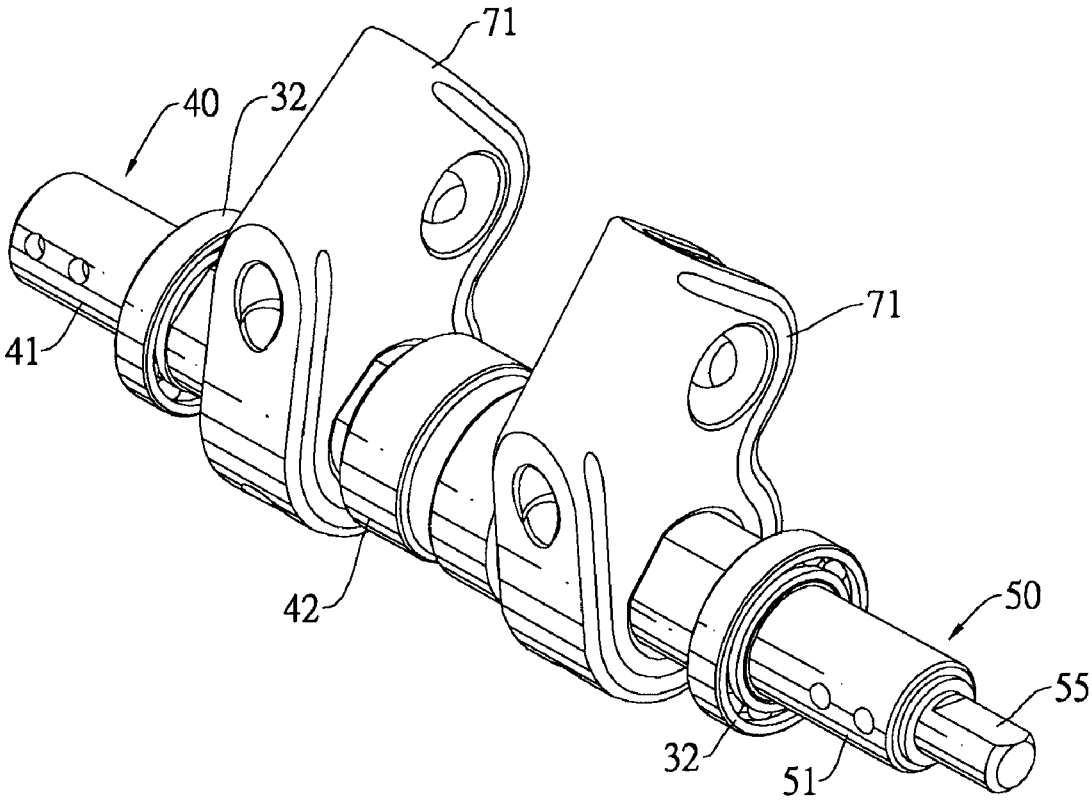
FIG. 5 is another enlarged perspective view of the first and second shafts of the pedal in FIG. 4.
Figure 6:
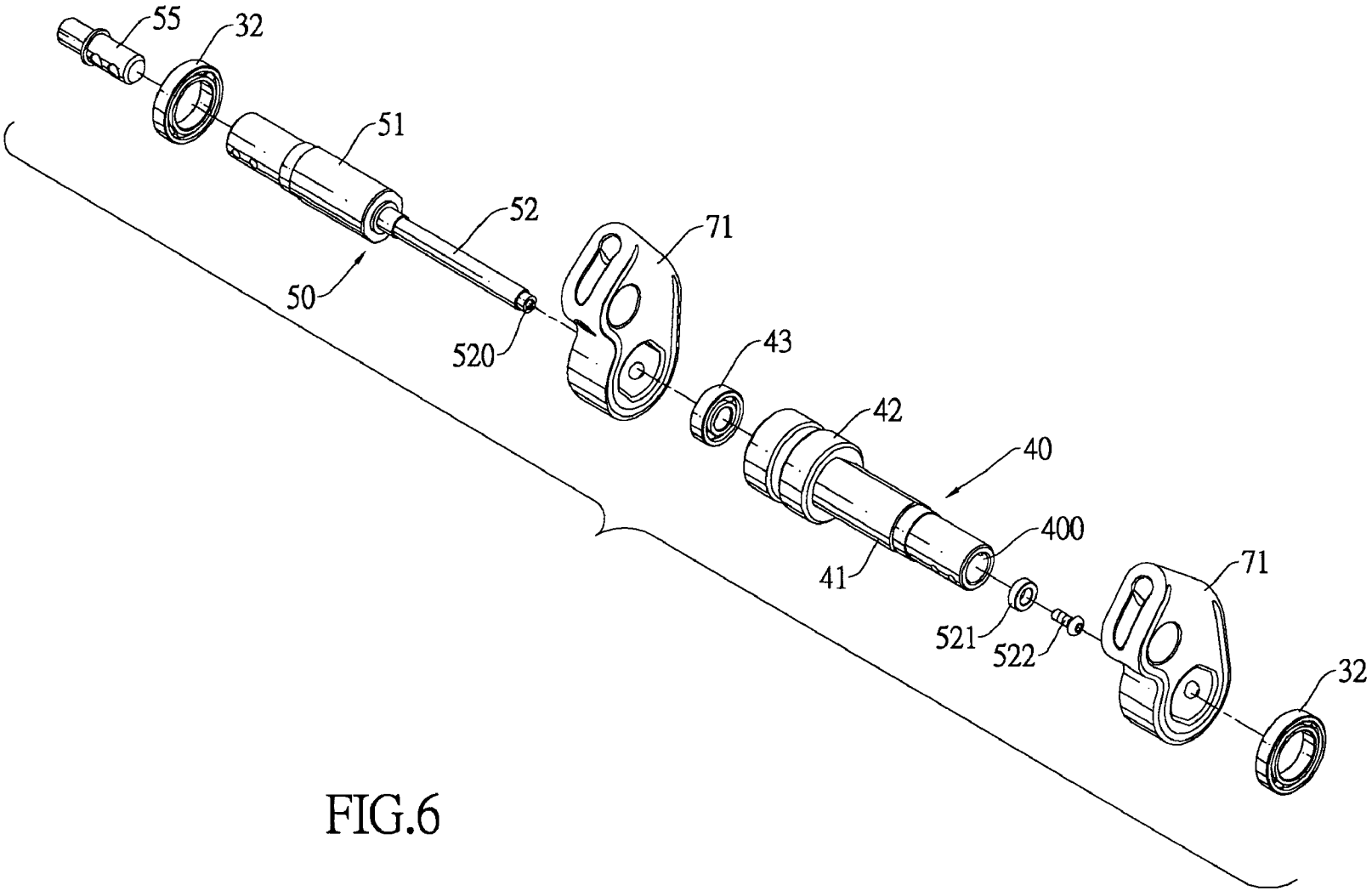
FIG. 6 is an exploded perspective view of the first and second shafts of the pedal in FIG. 4.
Figure 7:
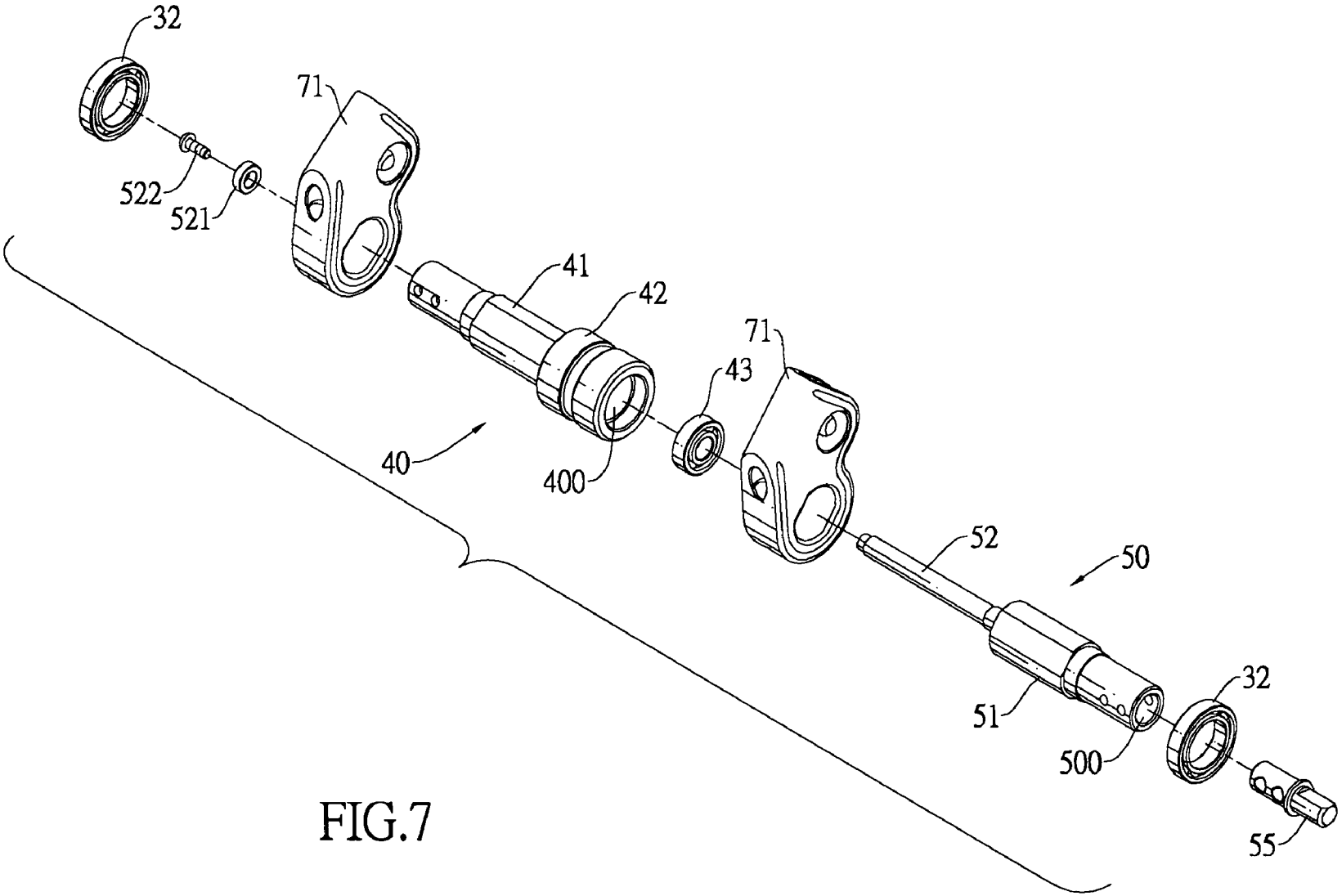
FIG. 7 is another exploded perspective view of the first and second shafts of the pedal in FIG. 5.

With reference to FIGS. 1 to 3, a pedal in accordance with the present invention is used for musical instruments, especially for percussion instruments, such as but not limited to bass drums, and comprises a base (10), two supporting posts (30), a pedal plate (20), a first shaft (40), a second shaft (50), a chain assembly (60) and two beaters (70) and may further have two positioning assemblies (80).

The base (10) is flat.

Figure 8:
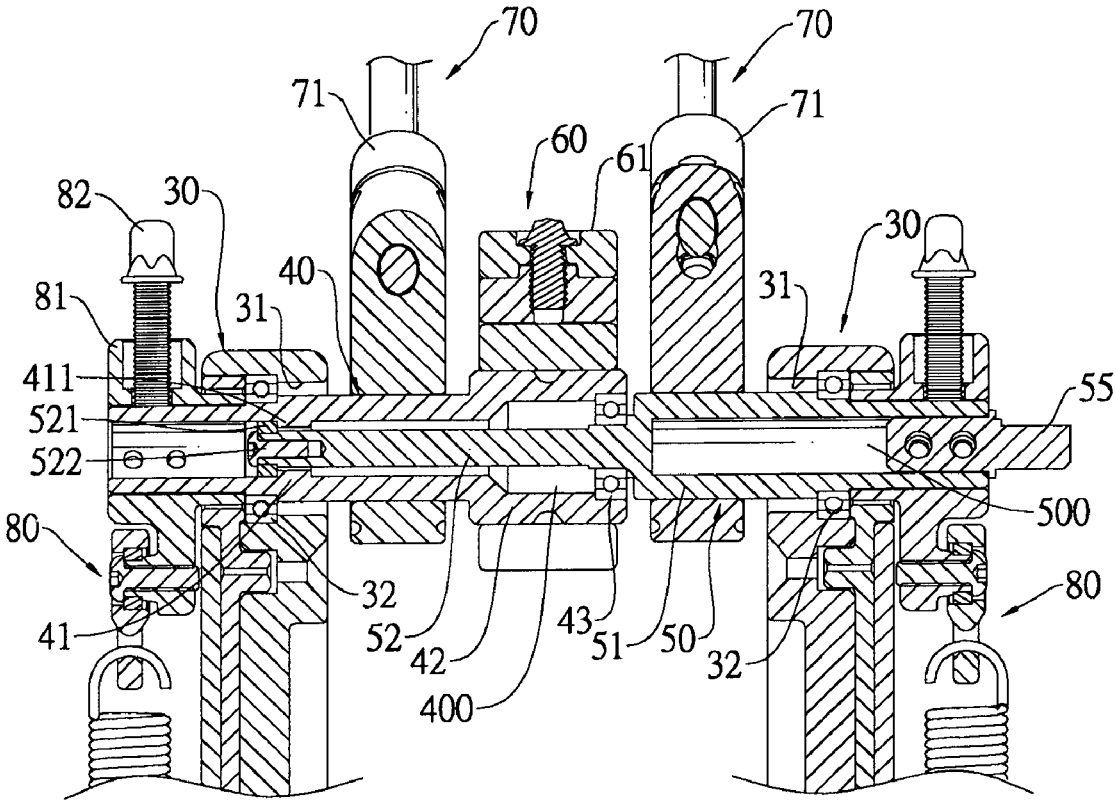
FIG. 8 is an enlarged cross sectional rear view of the pedal in FIG. 1.

With further reference to FIG. 8, the supporting posts (30) are mounted uprightly on the base (10) and each supporting post (30) may have a pivot hole (31) and a supporting bearing (32). The pivot hole (31) is defined through the supporting post (30). The supporting bearing (32) is mounted in the pivot hole (31).

The pedal plate (20) is mounted on the base (10) between the supporting posts (30) and has a rear end (21) and a fore end (22). The rear end (21) is mounted pivotally on the base (10). The fore end (22) is defined opposite to the rear end (21) and is lifted over the base (10).

With further reference to FIGS. 4 to 7, the first shaft (40) is mounted rotatably on and corresponds to one of the supporting posts (30), has a shaft hole (400) and may further have a mounting section (41), a connecting section (42) and an inner bearing (43).

The shaft hole (400) is defined longitudinally in the first shaft (40) and may have an inner surface and an inner annular shoulder (411). The inner annular shoulder (411) is formed on and protrudes radially from the inner surface.

The mounting section (41) is mounted rotatably through the pivot hole (31) of the corresponding supporting post (30), may be mounted through and held by the supporting bearing (32) in the pivot hole (31) and has an outside end and an inside end defined opposite to the outside end.

The connecting section (42) is formed on and protrudes longitudinally from the inside end of the mounting section (41) toward the other supporting post (30).

The inner bearing (43) is mounted in the shaft hole (400).

Figure 9:
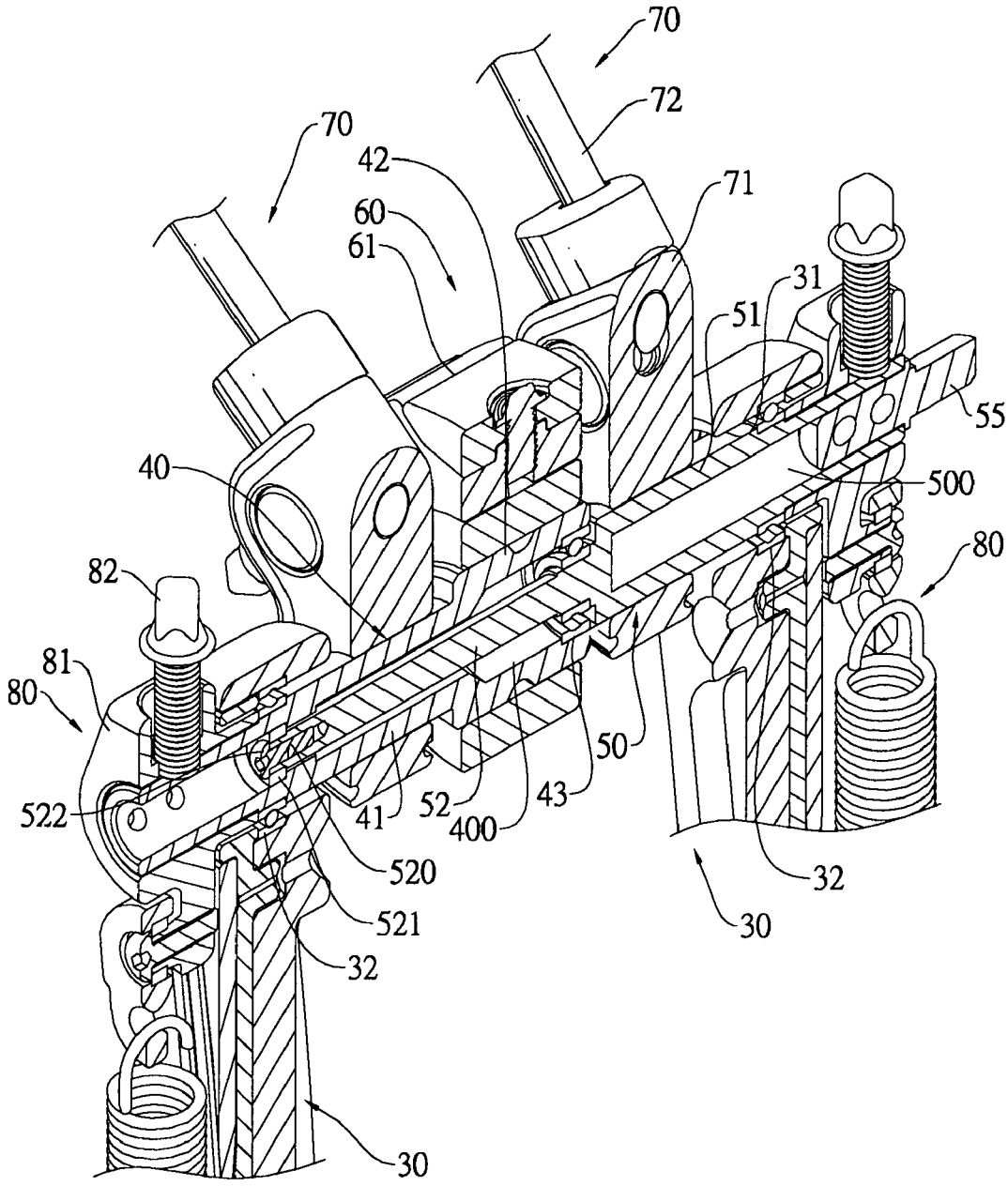
FIG. 9 is an enlarged perspective view of the pedal in FIG. 8.

With further reference to FIGS. 8 and 9, the second shaft (50) is mounted rotatably on and corresponds to the other supporting post (30) and rotatably extends in the shaft hole (400) of the first shaft (40) so that the first and second shafts (40, 50) are capable of rotating independently around a same axis. Therefore, the first and second shafts (40, 50) are capable of rotating independently and concentrically. Furthermore, the first and second shafts (40, 50) are connected to each other to serve as a crossbeam mounted between the supporting posts (30) and reinforcing the structural strength of the pedal. The second shaft (50) may have a mounting segment (51) and a connecting segment (52).

The mounting segment (51) is mounted rotatably through the pivot hole (31) of the corresponding supporting post (30), may be mounted through and held by the supporting bearing (32) in the pivot hole (31) and has an outside end and an inside end and may further have a connecting hole (500) and a secondary-pedal-connecting pin (55). The inside end is defined opposite to the outside end. The connecting hole (500) is defined in the outside end of the mounting segment (51). The secondary-pedal-connecting pin (55) is mounted in the connecting hole (55) and may be connected externally to a secondary pedal to allow a player to use both feet to drive both beaters (70) that will be further described in the following paragraphs.

The connecting segment (52) is formed on and protrudes longitudinally from the inside end of the mounting segment (51) toward the other supporting post (30) and rotatably extends in the shaft hole (400) through the connecting section (42) of the first shaft (40). The connecting segment (52) may be mounted through and held by the inner bearing (43) in the shaft hole (400). Furthermore, the connecting segment (52) may have an inside end, a fastening hole (520), a stabilizing bearing (521) and a fastening element (522). The fastening hole (520) is defined in the inside end of the connecting segment (52). The stabilizing bearing (521) is mounted in the shaft hole (400), is mounted around and holds the inside end of the connecting segment (52) and abuts and hooks on the inner annular shoulder (411). The fastening element (522) is mounted in the fastening hole (520) and holds the stabilizing bearing (521) on the connecting segment (52).

The chain assembly (60) is connected to the fore end (22) of the pedal plate (20) and the first shaft (40) and may have a fastener (61) and a chain (62).

The fastener (61) is mounted detachably on the connecting section (42) of the first shaft (40).

The chain (42) has two ends. One end is mounted on the fastener (61) and the other end is mounted to the fore end (22) of the pedal plate (20). Therefore, stepping on the pedal plate (20) pulls the chain (42) and rotates the first shaft (40).

The beaters (70) are transversely mounted respectively on the first and second shafts (40, 50). Each beater (70) may have a mounting bracket (71), a rod (72) and a striking head (73). The mounting bracket (71) is mounted securely around one of the first and second shafts (40, 50). The rod (72) is mounted through the mounting bracket (71) and has a distal end. The striking head (73) is mounted on the distal end of the rod (72) and may strike a percussion instrument such as a bass drum.

The positioning assemblies (80) are mounted respectively on and correspond to the supporting posts (30) and each positioning assembly (80) has a post mount, a sleeve (81), a fastening bolt (82) and a spring. The post mount is mounted securely on a corresponding supporting post (30). The sleeve (81) is mounted around the mounting section or segment (41, 51) of the first or second shafts (40, 50) and has a transverse threaded hole defined radially in the sleeve (81). The fastening bolt (82) is mounted in the transverse threaded hole of the sleeve (81) and abuts the mounting section or segment (41, 51) to ensure that the sleeve is capable of rotating with the first or second shaft (40, 50). The spring is connected between the post mount and sleeve (81) to provide resilient force.

The first and second shafts (40, 50) are connected concentrically together to serve as a crossbeam mounted between the supporting posts (30) to improve structural strength of the pedal without further mounting additional crossbeams between the supporting posts. Therefore, the pedal plate (20) has a maximum pivoting range that is not limited by any redundant crossbeams.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pedal for musical instruments comprising:

a base;

two supporting posts mounted uprightly on the base;

a pedal plate mounted on the base between the supporting posts and having a rear end mounted pivotally on the base; and a fore end defined opposite to the rear end and lifted over the base;

a first shaft mounted rotatably on and corresponding to one of the supporting posts and having a shaft hole defined longitudinally in the first shaft;

a second shaft mounted rotatably on and corresponding to the other supporting post and rotatably extending in the shaft hole of the first shaft, and the first and second shafts being capable of rotating independently and concentrically and connected to each other to serve as a crossbeam between the supporting posts;

a chain assembly connected to the fore end of the pedal plate and the first shaft; and two beaters transversely mounted respectively on the first and second shafts;

wherein each supporting post has a pivot hole defined through the supporting post;

wherein the first shaft has a mounting section mounted rotatably through the pivot hole of the corresponding supporting post and having an outside end and an inside end defined opposite to the outside end; and a connecting section formed on and protruding longitudinally from the inside end of the mounting section;

wherein the second shaft has a mounting segment mounted rotatably through the pivot hole of the corresponding support post and having an outside end and an inside end defined opposite to the outside end; and a connecting segment formed on and protruding longitudinally from the inside end of the mounting segment and rotatably extending in the shaft hole through the connecting section of the first shaft;

wherein the shaft hole of the first shaft has an inner surface and an inner annular shoulder formed on and protruding radially from the inner surface; and wherein the connecting segment of the second shaft has an inside end and a stabilizing bearing mounted in the shaft hole, mounted around and holding the inside end of the connecting segment and abutting and hooking on the inner annular shoulder.

2. The pedal and claimed in claim 1, wherein the shaft hole of the first shaft further has an inner bearing mounted in the shaft hole and mounted around and holding the connecting segment.

3. The pedal as claimed in claim 2, wherein each supporting post further has a supporting bearing mounted in the pivot hole and the supporting bearings of the supporting posts are mounted respectively on and hold the mounting section and segment of the first and second shafts.

4. The pedal as claimed in claim 1, wherein the second shaft further has a connecting hole defined in the outside end of the mounting segment; and a secondary-pedal-connecting pin mounted in the connecting hole.

5. The pedal as claimed in claim 3, wherein the second shaft further has a connecting hole defined in the outside end of the mounting segment; and a secondary-pedal-connecting pin mounted in the connecting hole.

6. The pedal as claimed in claim 1, wherein the chain assembly has a fastener mounted detachably on the connecting section of the first shaft; and a chain having two ends, one end mounted on the fastener and the other end mounted to the fore end of the pedal plate.

7. The pedal as claimed in claim 5, wherein the chain assembly has a fastener mounted detachably on the connecting section of the first shaft; and a chain having two ends, one end mounted on the fastener and the other end mounted to the fore end of the pedal plate.

8. The pedal as claimed in claim 1, further comprising two positioning assemblies mounted respectively on and corresponding to the supporting posts and each positioning assembly having a post mount mounted securely on an corresponding supporting post;

a sleeve mounted around the mounting section or segment of the first or second shaft and having a transverse threaded hole defined radially in the sleeve;

a fastening bolt mounted in the transverse threaded hole of the sleeve and abutting the mounting section or segment; and a spring connected between the post mount and sleeve.

9. The pedal as claimed in claim 7 further comprising two positioning assemblies mounted respectively on and corresponding to the supporting posts and each positioning assembly having a post mount mounted securely on a corresponding supporting post;

a sleeve mounted around the mounting section or segment of the first or second shaft and having a transverse threaded hole defined radially in the sleeve;

a fastening bolt mounted in the transverse threaded hole of the sleeve and abutting the mounting section or segment; and a spring connected between the post mount and sleeve.

10. The pedal as claimed in claim 1, wherein each beater has a mounting bracket mounted securely around one of the first and second shafts;

a rod mounted through the mounting bracket and having a distal end; and a striking head mounted on the distal end of the rod.

11. The pedal as claimed in claim 9, wherein each beater has a mounting bracket mounted securely around one of the first and second shafts;

a rod mounted through the mounting bracket and having a distal end; and a striking head mounted on the distal end of the rod.

* * * * *